US010588441B2

(12) United States Patent
Gariti

(10) Patent No.: US 10,588,441 B2
(45) Date of Patent: Mar. 17, 2020

(54) SUPPORT STAND ASSEMBLY

(71) Applicant: Thomas Victor Gariti, Chicago, IL (US)

(72) Inventor: Thomas Victor Gariti, Chicago, IL (US)

( * ) Notice: Subject to any disclaimer, the term of this patent is extended or adjusted under 35 U.S.C. 154(b) by 0 days.

(21) Appl. No.: 15/777,572

(22) PCT Filed: Nov. 18, 2016

(86) PCT No.: PCT/US2016/062924
§ 371 (c)(1),
(2) Date: May 18, 2018

(87) PCT Pub. No.: WO2017/087889
PCT Pub. Date: May 26, 2017

(65) Prior Publication Data

US 2019/0029454 A1 Jan. 31, 2019

Related U.S. Application Data

(60) Provisional application No. 62/257,286, filed on Nov. 19, 2015.

(51) Int. Cl.
*A47G 33/12* (2006.01)

(52) U.S. Cl.
CPC ..... *A47G 33/12* (2013.01); *A47G 2033/1293* (2013.01)

(58) Field of Classification Search
CPC ..... A47G 33/12; A47G 2033/1293
See application file for complete search history.

(56) References Cited

U.S. PATENT DOCUMENTS 2,747,820 A * 5/1956 Blu ..... A47G 33/12 248/188.8
4,408,415 A 10/1983 Davis et al.
4,699,347 A * 10/1987 Kuhnley ..... A47G 33/1213 248/230.8
5,114,113 A 5/1992 Krinner
(Continued)

OTHER PUBLICATIONS

United States Patent and Trademark Office, International Search Report in International Application No. PCT/US2016/062924 (dated Mar. 17, 2017).

(Continued)

*Primary Examiner* — Anita M King
(74) *Attorney, Agent, or Firm* — Neal, Gerber & Eisenberg LLP; Bradley Rademaker; Nawshaba Siddiquee

(57) ABSTRACT

A stand device having a housing with a base and an upper body, the upper body having a top opening for receiving the bottom of a tree and having an upstanding sidewall extending in a circumferential arrangement to define an inner chamber with a chamber height. The assembly having a securement assembly with at least one adjustable strap residing along a generally horizontal plane with a tightening mechanism, the tightening mechanism having at least one engagement surface aligned with a mating surface of the strap, wherein movement of the actuator forces said engagement surface against the mating surface of the strap to reduce the diameter of the strap loop. The assembly further having a horizontally extending tube that has an upward curved portion with an opening located at or below the height of the inner chamber.

25 Claims, 9 Drawing Sheets

(56) References Cited

U.S. PATENT DOCUMENTS

| | | | | | |
|---|---|---|---|---|---|
| 5,159,780 | A | * | 11/1992 | Molthen | A01G 9/12 248/523 |
| 5,249,772 | A | * | 10/1993 | Montie, Jr. | A47G 33/12 248/516 |
| 5,279,071 | A | * | 1/1994 | McDougall | A01G 27/003 428/16 |
| 5,301,462 | A | * | 4/1994 | Hronyetz | A47G 33/1226 248/521 |
| 5,337,990 | A | | 8/1994 | Brown | |
| 5,393,031 | A | | 2/1995 | Leve | |
| 5,398,444 | A | * | 3/1995 | Murray | A47G 33/1226 248/515 |
| 5,577,701 | A | | 11/1996 | Plzak | |
| 5,799,437 | A | * | 9/1998 | Evans | A01G 27/005 340/618 |
| 5,842,676 | A | * | 12/1998 | Plzak | A47G 33/1226 248/523 |
| 6,367,195 | B1 | | 4/2002 | Heyworth | |
| 7,597,304 | B1 | | 10/2009 | Gray | |
| 7,600,342 | B2 | | 10/2009 | Fiveash | |
| 8,607,420 | B2 | | 12/2013 | De Campos et al. | |
| 2007/0089360 | A1 | * | 4/2007 | Koch | A01G 27/006 47/40.5 |
| 2011/0214345 | A1 | | 9/2011 | Rasschaert | |

OTHER PUBLICATIONS

United States Patent and Trademark Office, Written Opinion of the International Searching Authority in International Application No. PCT/US2016/062924 (dated Mar. 17, 2017).

* cited by examiner

SUPPORT STAND ASSEMBLY

CROSS REFERENCE TO RELATED APPLICATIONS

This application is a U.S. National Phase Application of International Application No. PCT/US2016/062924, filed on Nov. 18, 2016, which claims priority to U.S. Provisional Patent Application No. 62/257,286, filed on Nov. 19, 2015, which is hereby incorporated herein by reference in its entirety.

BACKGROUND

1. Technical Field

The present invention relates to a support stand with an adjustable mechanism for securing an elongated structure such as a Christmas tree to the stand and a water supply assembly.

2. Background Information

Support stands are used for securing elongated structures, such as with Christmas trees, either as trees cut for use as decoration or imitation trees assembled for such use. Trees are often used for Christmas decorations and for other decorative purposes for personal and commercial use. In the case of imitation trees, a lower trunk, typically formed as a round tubular structure, is secured to a stand as a base. With real trees used as decorations, after the tree has been cut or removed from the ground, the tree must be supported at the base of the tree to keep the tree upright. In each case, branches or the tree extend outwardly from the trunk of the tree which increases the weight and instability of the tree in an upright position. Similarly, other cylindrical bases of elongated structures, including poles for banners or flags used at parties, fundraisers and trade shows, volleyball nets, and like structures, require a stable base to hold the object upright and resist external forces of imbalanced weight or the wind.

In the past, stands for trees and poles have used certain shapes and fastening mechanisms for securing the tree or pole to the stand, such as a round circular stand with an inner cavity shaped to surround the trunk of the tree or pole, and threaded bolts extending from the stand to hold the tree or pole in position within the stand. However, such arrangements have difficulties and limitations. For example, the bolts may become loose, are often difficult to sufficiently tighten, and the structural arrangement of bolts extending from opposed positions may be insufficient to support the weight of the tree or the pole.

Further, in the case of real trees being used as decorations, whereby a tree has been cut or removed from the ground, a supply of water at the base of the tree is required to prolong the decorative appearance of the tree. Therefore, it is common for tree stands to include a chamber or cavity at the base of the tree for holding water. This structure presents difficulties for a user to fill the water chamber, requiring the user to crawl under the tree to pour water into the chamber surrounding the base of the tree. Also, it is often difficult to see the water level in the chamber, causing the water to be too low or to be filled too high and thereby spill over the top of the chamber of the tree stand. These water cavities also often conform to the base of the tree to support the tree and thereby have a relatively small volume and require repeated filling over time and prevent a user from being able to leave the tree unattended for a lengthy period of time. A suitable solution for these and other problems with common tree stands is desired, and which is fulfilled by the present invention.

BRIEF SUMMARY

One aspect of the present invention concerns a stand assembly which included a top, a base, and a wall structure that cooperatively form an inner area or chamber for receiving and securing the base of a tree or similar elongated structure. The wall preferably is an upright circumferential wall structure that extends from the top to the base, wherein the juncture of the wall and the base is sealed to form a chamber for holding liquid and the top includes an opening configured for receiving the base of the tree. The assembly includes at least one adjustable strap secured to the stand, preferably connected at a plurality of generally opposed slots or projections within the circumference of the inner area, and has a tightening mechanism configured to gather the strap at a range of locations along the length of the strap to adjust the loop of the strap. In one embodiment, at least one actuator is connected to the tightening mechanism, such as a rod that extends from the tightening mechanism, to provide access for a user to manipulate the mechanism for tightening the adjustable strap. Further, in a preferred embodiment, the wall includes at least one hole for passage of an extent of the at least one rod. In another preferred form of the invention, the stand has four sides that cooperatively form a pyramid-shaped support with an inner chamber.

It is also an object of the present invention to provide a support stand for securing a tree within an inner chamber having a side opening in fluid communication with a tube that extends outward from the chamber horizontally and has an upward curved end portion that is positioned an extent away from the chamber with an opening for receiving fluid to pass within the tube and into the chamber. In a preferred form of the invention, the distal opening of the tube is located at a height that is at least greater than half the height of the chamber, and preferably at least the height of the chamber.

It is also an object of the present invention to provide a method of securing a cylindrical element including the steps of providing a stand device at least one adjustable strap residing along a generally horizontal plane within an inner area of a support stand, wherein the strap has a loop that is adjustable by rotating a tightening mechanism that forces the strap through the mechanism to reduce the loop diameter.

DETAILED DESCRIPTION

The present invention provides a stable support stand suitable for upright support of a decorative tree, such as a Christmas tree or flag or banner pole, providing structural features for an efficient securement assembly to support the tree or like structure which is easily put into use and maintained. The main features of the present invention is to provide a stable stand with a securement assembly that utilizes versatility of an adjustable strap, provides convenient access for a user tightening the securement assembly and, in the situation of supporting a tree, convenience for a user to maintain a suitable water level within the stand. As shown in the Figures, a stand assembly 100 with such features is provided, demonstrated in differing embodiments of the present invention.

FIGS. 1-3 and 7-8 show an embodiment in which the assembly 100 has an overall pyramid shape formed of generally opposed walls 106, thus providing enhanced stability and other benefits of the structure described herein. This embodiment is particularly suitable for supporting large decorative trees and may have enhanced features of the components described herein. For example, this embodiment is particularly suitable for a tree stand that is enlarged for added stability, has a securement assembly 162 that has a motorized assembly for driving the tightening assembly and has a water tube extending far from the wall 106 of the assembly 100.

Figure 3:
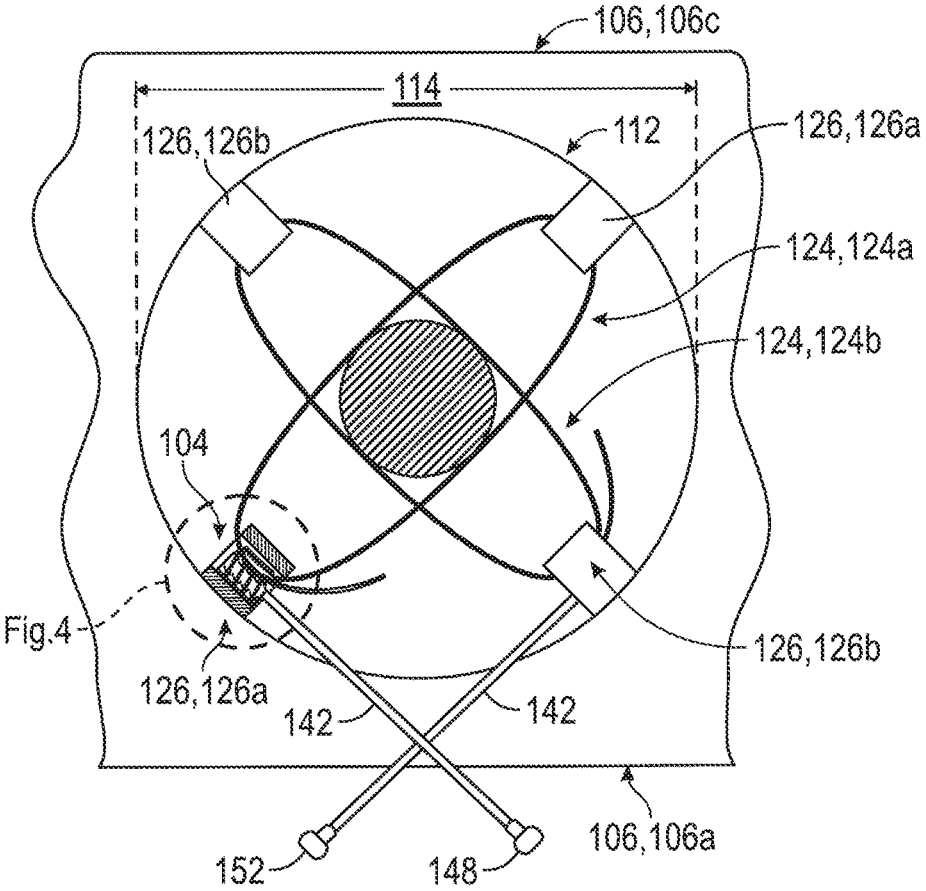
FIG. 3 shows a top view of an assembly according to FIG. 1.
Figure 9:
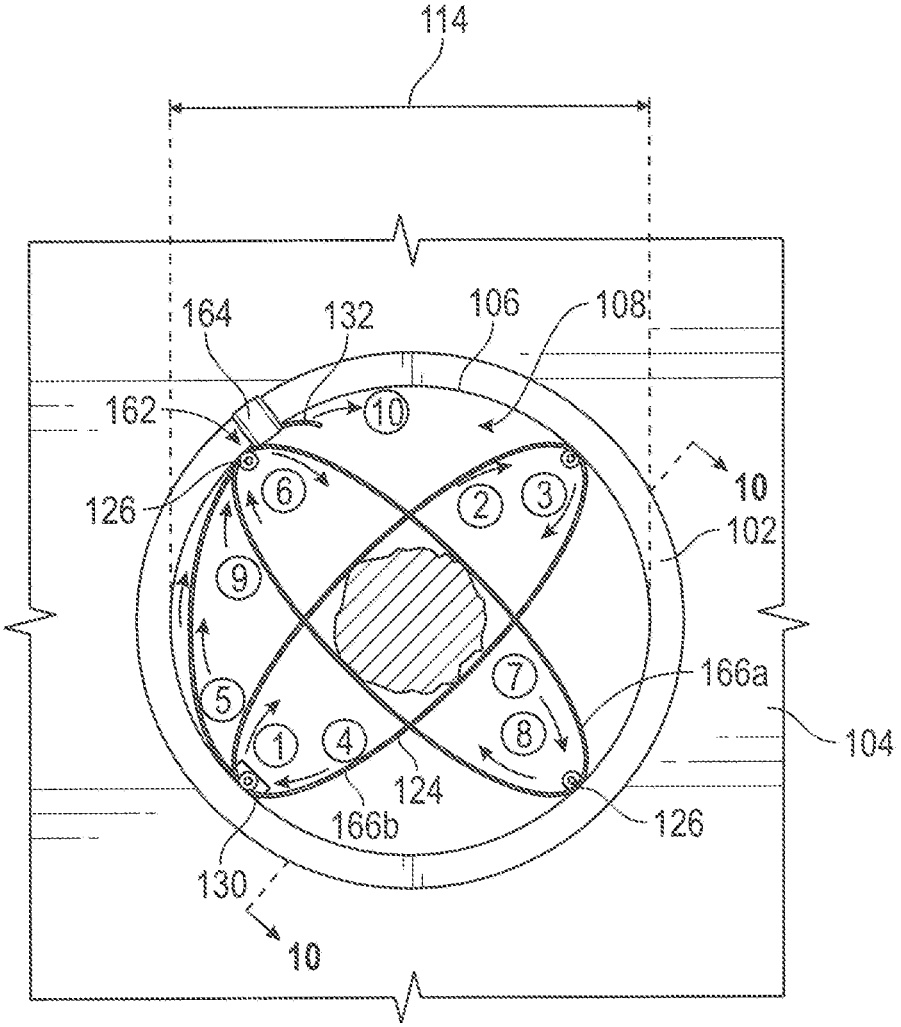
FIG. 9 is a top view of a tree stand according to the present invention, with the tree in the center shown in cross section.
Figure 10:
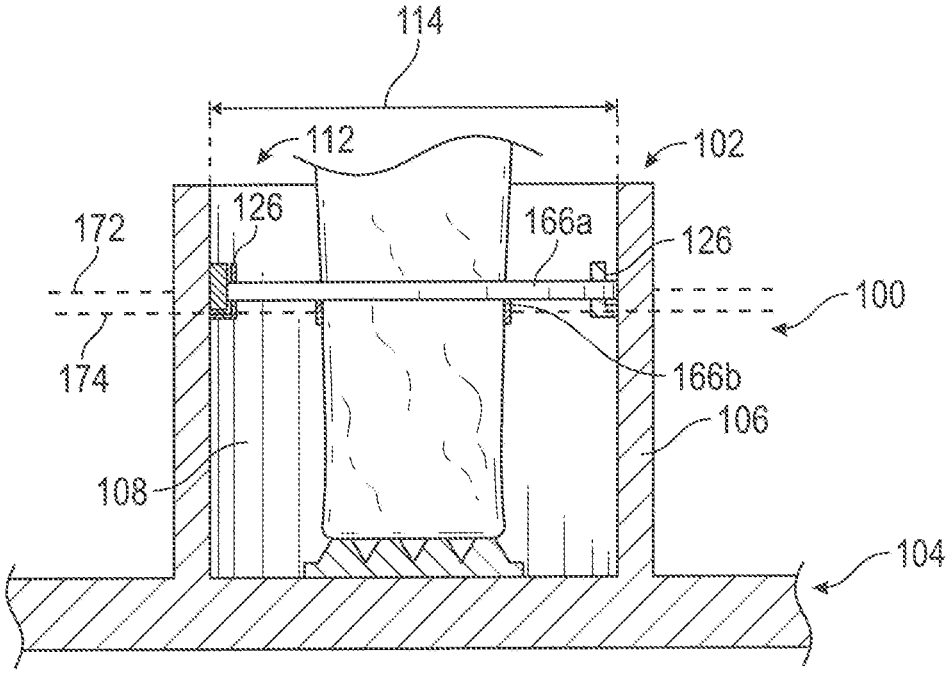
FIG. 10 is a sectional view of the tree stand of FIG. 9, along sectional lines identified in FIG. 9.
Figure 11:
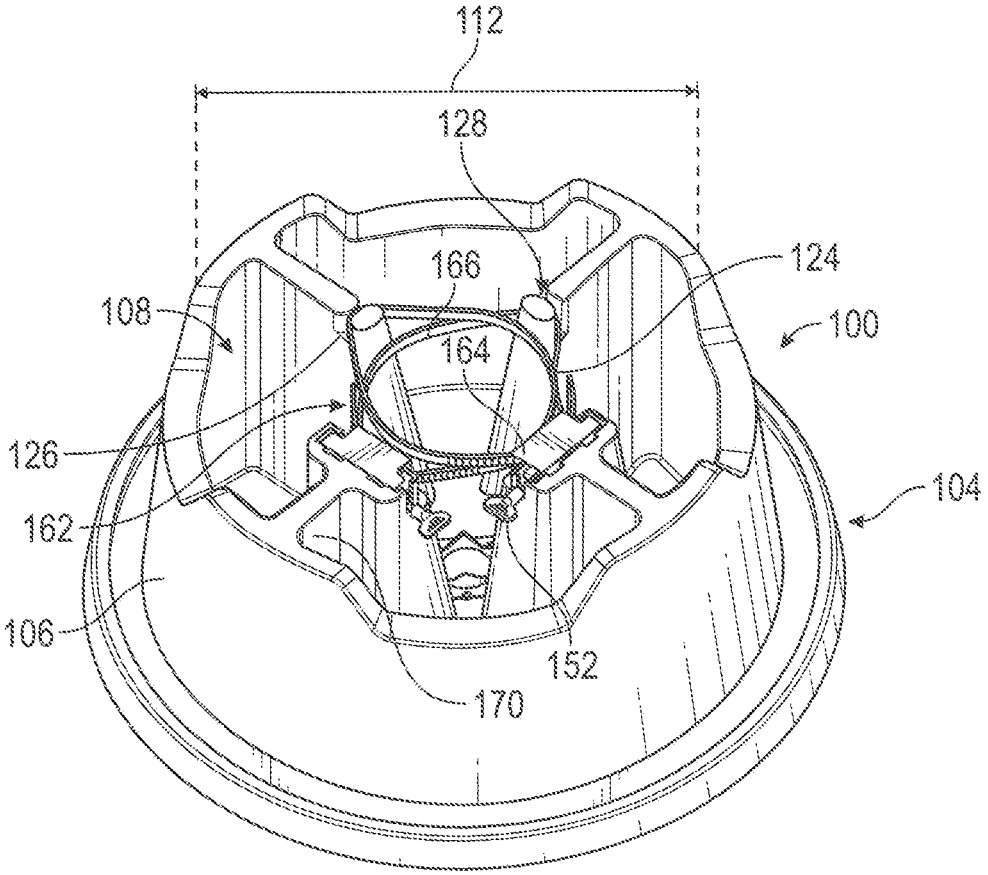
FIG. 11 is an elevated perspective view of a tree stand according to an embodiment of the present invention.

FIGS. 9-10 show a differing embodiment in which the stand assembly 100 has a circumferential wall 106 that defines an inner chamber, and a base 104 shown as a larger square shape, which instead may of course be of a different shape or be comprised of elongated legs extending from the lower region of the wall structure 106. This embodiment also may be suitable for larger trees, and especially trees having a larger diameter trunk, such as is common in some geographic regions. In this embodiment, the side wall structure 106 is shown as a cylindrical chamber, which may instead be formed from a plurality of upstanding walls arranged in other shapes such as hexagonal, and has an internal securement assembly 162 that may utilize one elongated strap as shown in FIG. 9, or may utilize more than one elongated strap cooperating to engage the tree to hold it upright. Further, this embodiment is particularly suitable for providing a tightening mechanism assembly 164 that is positioned within the side wall 106 rather than attached to an inner surface of the side wall 106 as shown in FIG. 3 or secured within the chamber as shown in FIG. 11.

FIGS. 11-14 show yet another embodiment, in which the assembly includes a main body that may be formed of molded material, such as plastic, having a side wall structure 106 and a lower bottom or base 104. This embodiment is particularly suitable for providing an assembly 100 that has a stackable geometry, such as being capable of being stacked in a retail point-of-purchase setting, with certain components disclosed herein, such as the securement assembly 162 and watering tube 202, assembled by a user after the purchase and the desired compactness of retail display. The stackable geometry may be available by providing cavities on the underside of the assembly (FIG. 13) and by the ease with which the securement assembly 162 (including the straps 124 and tightening assembly 164) may be installed into the stand by simply inserting the securement assembly components into their respective positions.

In a first embodiment of the present invention, which is primarily shown in FIGS. 1-3 and 7-8, the stand assembly has a generally triangular overall configuration with opposing side walls that slope radially inward from a wise base, to a relatively narrow top that has an opening to receive a tree or pole or the like. In the embodiment shown in FIGS. 1-3 and 7-8, the support stand assembly 100 has a top 102, a base 104, and a circumferential wall structure 106, all which cooperatively form a hollow inner chamber or inner area 108. The cooperative wall structure as shown in these figures has four sides 106*a*, 106*b*, 106*c*, 106*d* which each slope radially outward from the top 102 toward a wider region at the base 104. The structure provides stability of the stand assembly while maintaining a suitably sized top 102 for an opening that may receive a tree or similar object for supporting upright. Although the wall 106 of the assembly 100 shown in the Figures has four sides, 106*a*, 106*b*, 106*c*, 106*d*, this arrangement of a generally pyramid-shaped stand assembly may be achieved with other number of sides. In other examples, the wall 106 may include a circle or round shape, such as shown in other of the Figures, or include three or more generally flat sides. In the pyramid-shaped embodiment shown in the Figures, the material of the top 102, base 104, and four sides 106*a-d* are preferably formed of a rigid material that provides structural rigidity to the stand assembly, gaining the benefit of having a wide base and a narrow top. Suitable materials include wood, plastic, or metal. Further, the top 102, base 104, and four sides 106*a*, 106*b*, 106*c*, 106*d* may be formed from a single piece of material, such as molded plastic as shown in FIGS. 11-14, or may be formed of separate pieces integrally connected with one another with adhesive or fasteners or mechanical engagement.

When the wall 106 of the assembly 100 has a plurality of sides 106*a-d* forming the circumferential wall 106, the top 102 of the assembly 100 may have a square shape with a first length 110 and an opening 112. Alternatively, the opening 112 may have a circular or similar shape for receiving the trunk of a tree or a pole and has a characteristic diameter 114 of the opening. Regardless, the opening of the top is configured to be large enough to receive a tree trunk or like object. Indeed, although the assembly 100 is described as for use with securing a tree, the disclosure is not so limited. In other examples, the assembly 100 may be used for securing a cylindrical element to the assembly 100 such as poles for banners used at parties, fundraisers and trade shows, volleyball nets, flags, and patio umbrellas. The base 104 of the assembly 100 may have a square shape with a second length 116 larger than the first length 110 of the top 102, and the sides (shown as four sides, 106*a*, 106*b*, 106*c*, 106*d*) of the stand assembly 100 extend from the top 102 to the base 104 to form an overall pyramid shape. The pyramid shape of the assembly 100 provides for enhanced structural integrity. In this aspect of the invention, the second length 116 of the base 104 is larger than the overall width 110 of the top 102, and hence at least some portion of the base 104 is broader than the top 102 to provide enhanced stability due to a larger base to resist tipping and a lower center of gravity. This aspect of an assembly made according to the present invention provides stability when a tree or other structure is positioned within the assembly and secured to the assembly in an upright position. While this enhanced stability and structure is provided by sloping walls that extend radially outward as they approach the base 104, alternative structures may be achieved wherein the circumferential wall 106 it formed of generally vertical structure and at least a portion of the base extends radially outward from the wall 106 such that the overall width of base 104 is substantially greater than the width of the top 102 of the assembly, such as the example of FIG. 10.

Figure 1:
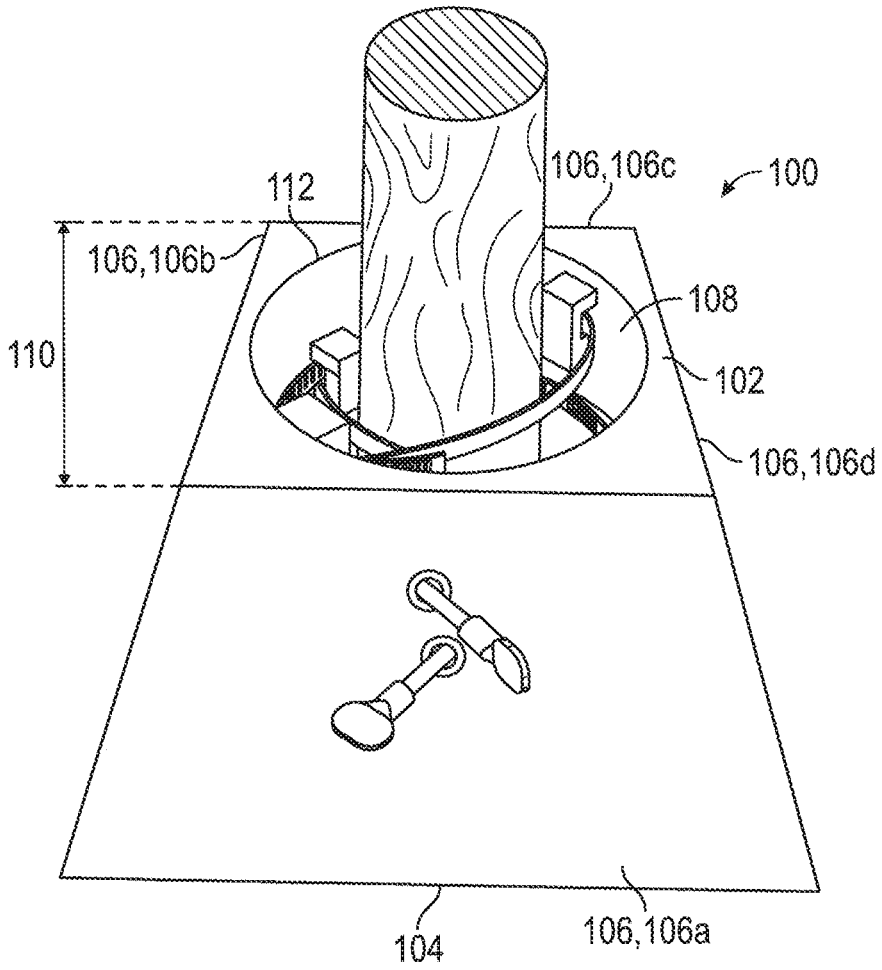
FIG. 1 is a perspective view of an embodiment of a stand assembly according to the present invention.
Figure 2:
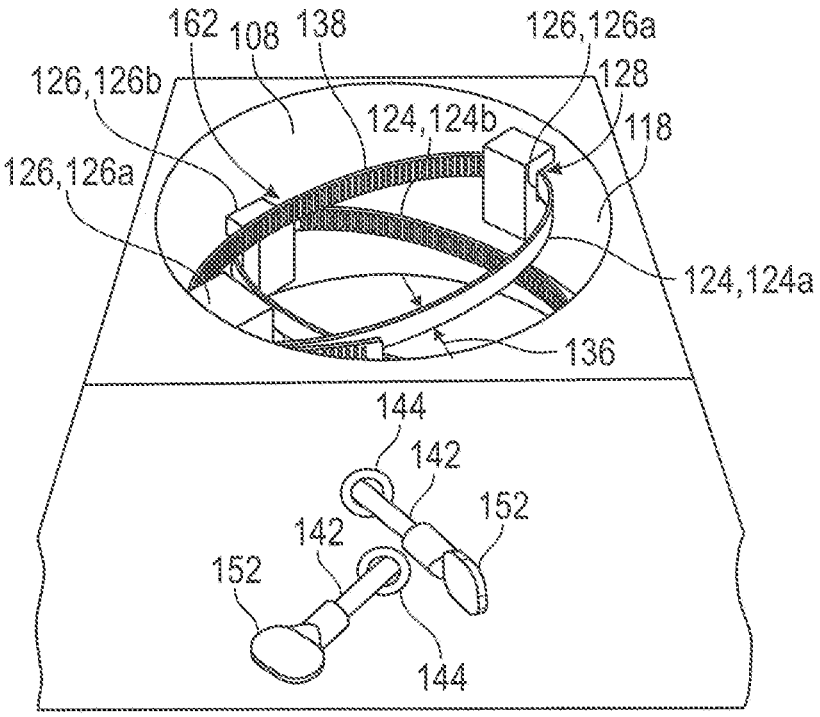
FIG. 2 is a partially exploded perspective view of the assembly of FIG. 1.
Figure 8:
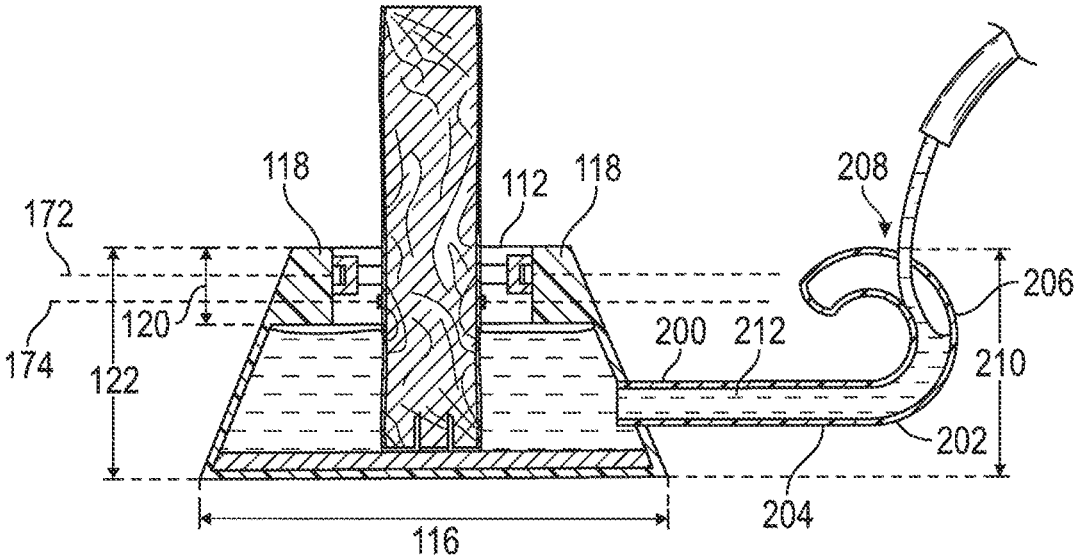
FIG. 8 shows a side sectional view of the assembly of FIG. 7.

As shown in FIGS. 2 and 8, the assembly 100 may include a shelf 118 positioned inward of the wall 106. In an embodiment, the shelf 118 extends from the top 102 of the assembly 100 radially inward, and preferably also extends downward toward the base 104 at a distance 120 less than a height 122 of the assembly 100—i.e., the height from the ground to the top opening. The shelf 118 also preferably has a characteristic diameter that coincides and substantially mates with the characteristic diameter 114 of the opening 112, and extends outward to the top of the side wall of the assembly. The material of the shelf 118 may include the same material as the top 102, base 104, and side 106. In the embodiment shown in FIGS. 1-7, the shelf 118 may be integral with the four sides 106*a*, 106*b*, 106*c*, 106*d*, or is secured to the four sides 106*a*, 106*b*, 106*c*, 106*d* via attachment means such as adhesive, fasteners, or other forms of secure mechanical attachment.

In the embodiment of a pyramid shaped assembly as shown, and especially an embodiment having an upper shelf as described above, the shape of the assembly 100 allows a large volume of water to be placed within the assembly 100, to provide water surrounding the base of the tree. Such volume of water allows for a user to avoid monitoring the water level frequently, and reduces the occasions in which water must be added by a user. Further, the larger volume of water that may by filled into the inner chamber 108, with a relatively narrow top opening, prevents pets from gaining access to the water supply, providing a significant inner chamber volume with a narrow top opening. In an alternate embodiment which provides a large water reservoir, the assembly 100 of FIG. 11 has a central area of the inner chamber 108 for receiving the base of a tree, with an inner chamber 108 that includes open compartments surrounding the central part of the chamber 108, resulting from inwardly protruding bodies 170 extending from the side wall 106 to provide a structure for attaching components of the securement assembly 162 in the appropriate position relative the opening receiving the tree base. The areas between the protruding bodies 170 comprise a volume of space that is in fluid communication with the central area of the inner chamber 108, thereby providing volume available for water within the chamber 108.

The assembly 100 includes a securement mechanism or assembly 162 that is comprised of a cooperative arrangement of at least one elongated strap 124 and related supporting structure, along with a tightening assembly or assembly 164 that is positioned and configured to adjust the position of lengths of the strap 124 relative the mechanism 164. As is appreciated from the Figures, the elongated strap 124 is aligned along generally horizontal planes 172, 174 within the inner space of the assembly 100, shown in the Figures as within the inner chamber 108 of the housing below the top 102. In an alternative arrangement, the inner area 108 may be a space defined by a collar or similar structure formed of a circumferential side wall structure 106 which receives the tree trunk and is integrally attached to the remainder of an assembly that has a lower chamber for water surrounding the base of a tree located below the collar.

The securement assembly 162 also preferably includes at least one slot 126 that provides an opening 128 for passage of the strap 124 for holding the strap in position adjacent the wall 106. For example, in the embodiment shown in FIGS. 1-3 and 8, the slots 126 and openings 128 may be formed as protruding bodies attached as inserts in the inner chamber 108 of the assembly. Similarly, in the embodiment shown in FIG. 11, the slots 126 and openings 128 for holding the strap in position may be formed in the molded material of the assembly itself. Significantly, in each such embodiment, the slot 126 provides securement of the strap in position while allowing the strap to move along the slot when tightening the strap to secure the tree. In this manner, each slot 126 provides passive securement of the strap 124, maintaining its position adjacent the wall, yet allowing an extent of the strap 124 to move along the slot. In an embodiment of this aspect of the invention, as shown in FIG. 9, the slot 126 may include a bearing or rotatable sheath that facilitates movement of the extent of the strap while maintaining its position relative the wall 106.

The securement assembly 162 comprises the parts of the device that hold the strap 124 in position and adjusts the size (i.e., the characteristic diameter) of a loop 166 of the strap to allow for the strap 124 to tighten against the base of the tree or other object. The strap 124 thereby has an extent that is configured and positioned to engage with the tree base when the loop 166 diameter is reduced after inserting the tree into the assembly 100. Thus, the assembly 100 may be characterized as having a housing with a base 104 and an upper body, wherein the upper body has a top 102 with an opening 112 configured for receiving an extent of a bottom or trunk of a tree. The upper body of the housing also has an upstanding sidewall 106 that extends from at least a portion of the base, and an extent of the side wall 106 forms a circumferential arrangement that defines an inner chamber 108 with a resulting chamber height 108*a* defined by the distance between the bottom of the wall and the top opening, residing within confines of the height 112 of the assembly 100. The securement assembly 162 has at least one adjustable strap 124 residing along a generally horizontal plane 172, 172 within the inner chamber, and includes a loop 166 of the strap 124 that is manipulated and adjusted by a tightening assembly 164. The tightening assembly 164 adjusts the loop segment 166 of the strap 124 to change the overall characteristic diameter of the loop 166 that surrounds the tree base. Part of the tightening assembly 164 that provides this adjustment is mechanical engagement of an actuator 168 that is used to force at least one engagement surface aligned with a mating surface of the strap 124, wherein movement of the actuator forces the engagement surface against the mating surface of the strap 124 to reduce the loop 166 diameter of the strap 124.

In a preferred embodiment such as shown in the figures, the loop 166 of the strap 124 has a first portion that is engaged with a stationary slot 126 of the wall, and the loop 166 has a second portion engaged with the tightening assembly 164. Further, the slot 126 may be formed in the body of the assembly, such as the wall 106, as a projection that extends an extent to provide a space for the strap to pass through, thereby connecting the strap while permitting movement of the strap along the projection when the loop diameter is reduced.

In an embodiment in which only one strap is used, such as shown in FIG. 9, the strap is engaged with at least two slots arranged about the inner chamber, and the strap 124 includes two loops within the inner chamber. In this embodiment, as shown in FIGS. 9 and 10, a central region of the first loop 166*a* resides generally along a first horizontal plane 172, and a central portion of the second loop 166*b* resides along a second horizontal plane 174 which is located adjacent the first plane, as shown in FIG. 10. In such an embodiment of using one strap, a first end of the strap is fixed in position at a location (FIG. 9 at Position 1), is strung through points of the housing formed by the other parts of the securement assembly 162 (i.e., the slots 126 and the tightening assembly 164), in the path shown with reference numbers 1-10 of FIG. 9. Specifically, the strap 124, passes around the slots 126 in the path shown, forming two loops residing generally along respective horizontal planes, and an end that passes through a tightening assembly 164 which may be manipulated to adjust the length of the strap 124 that form the loops within the chamber 108.

In an embodiment in which two or more straps 124 are used, each strap resides along a respective generally horizontal plane 172, 174 within the chamber and each is secured in position by at least one slot 126, whereby the length of each strap is adjusted by a respective tightening assembly 164. This is the preferred form of the invention, in which multiple straps 124 may be adjusted independently to provide optimal engagement of straps 124 against the tree to hold it in place, such as is shown in the embodiments of FIGS. 1-3 and 8 and in the embodiment shown in FIGS. 11-13.

Specifically, in the embodiment shown in FIGS. 1-3, the at least one adjustable strap 124 is connected within the inner area 108 of the assembly 100 via the plurality of slots 126 positioned within the area 108. The assembly 100 preferably includes two individual elongated adjustable straps 124, each residing on a respective generally horizontal plane 172, 174, each generally adjacent one another. In the embodiment of FIGS. 1-3, each slot 126, is located on the shelf 118 near the top of the assembly 100. The material of these slots 126 may include the same material as shelf 118, and may be integral with the shelf 118, or may be formed as a component secured to the shelf 118 via attachment with adhesives or fasteners. Notably, as an alternative as is shown in the embodiment of FIG. 11, the slots 126, may be formed as part of a molded assembly positioned inward of the side walls, shown in the figures as residing on inwardly protruding bodies 170.

The slots 126 include an opening 128 for positioning the straps 124 within the opening 128. The slots 126 may be positioned at varying circumferential positions about the inner area 108 (along positions about the diameter of the shelf 118), and in the case of multiple straps 124 being used, the slots 126 are positioned at the appropriate different heights within the inner area 108, and at the appropriate circumferential positions about the inner area, preferably opposite the tightening assembly 164. For example, as shown in FIGS. 2 and 3, two slots 126*a* are positioned on the shelf 118 at a first height relative the top 102, and two other slots 126*b* are positioned on the shelf 118 at a second height relative the top 102. The slots 126*b* are thus below the slots 126*a*, each being thereby aligned with a respective strap 124. The slots 126*a* are also positioned on opposing sides of the diameter of the inner area 108. Similarly, slots 126*b* are also positioned on opposing sides of the diameter of the inner area 108 and offset from the slots 126*a* by approximately 90 degrees. One adjustable strap 124*a* is positioned within the openings 128 of slots 126*a*, and the second strap 124*b* is positioned within the openings 128 of slots 126*b*. Thus, in this embodiment, at least a pair of slots 126 corresponds with one of the straps 124, and at least a pair of slots 126 corresponds with another strap 124. The positioning of the slots 126 and the adjustable straps 124 allow for multiple attachment locations of the tree to the assembly 100 to provide more secure and stable attachment. For example, as shown in FIGS. 1 and 3, one strap 124 minimizes lateral movement of the tree toward two sides or corners of the assembly 100, while the other strap 124 minimizes lateral movement of the tree toward the other two sides corners of the assembly 100.

Figure 12:
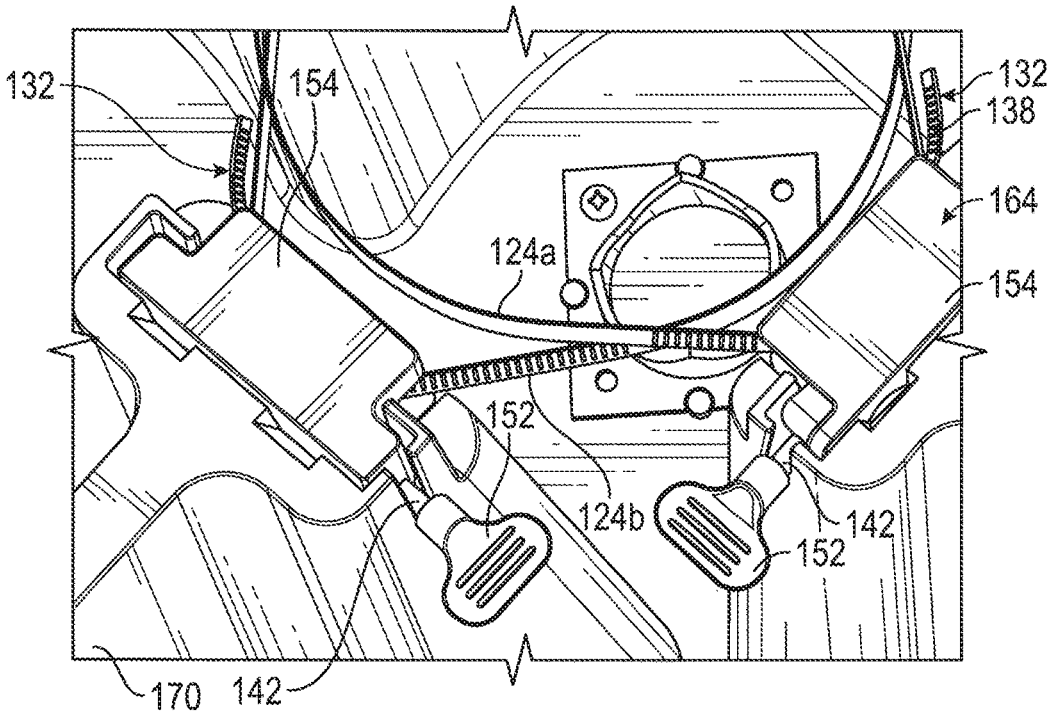
FIG. 12 is a magnified view of a portion of the tree stand depicted in FIG. 11.
Figure 13:
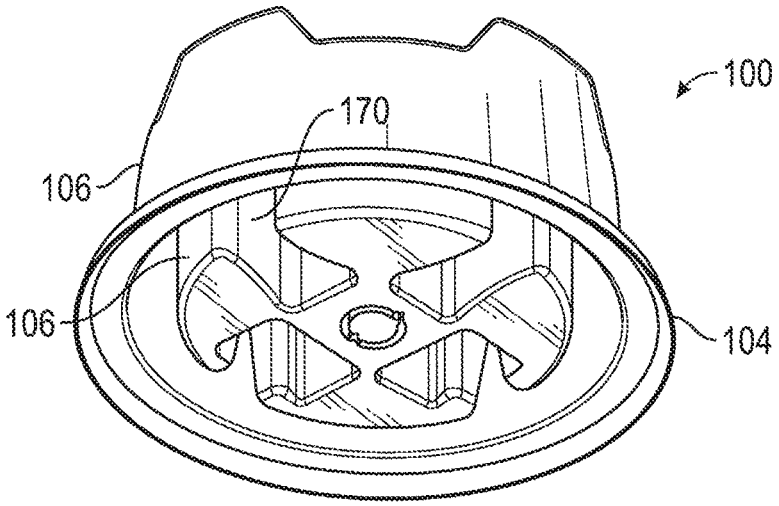
FIG. 13 is an underside view of the tree stand shown in FIG. 11.
Figure 14:
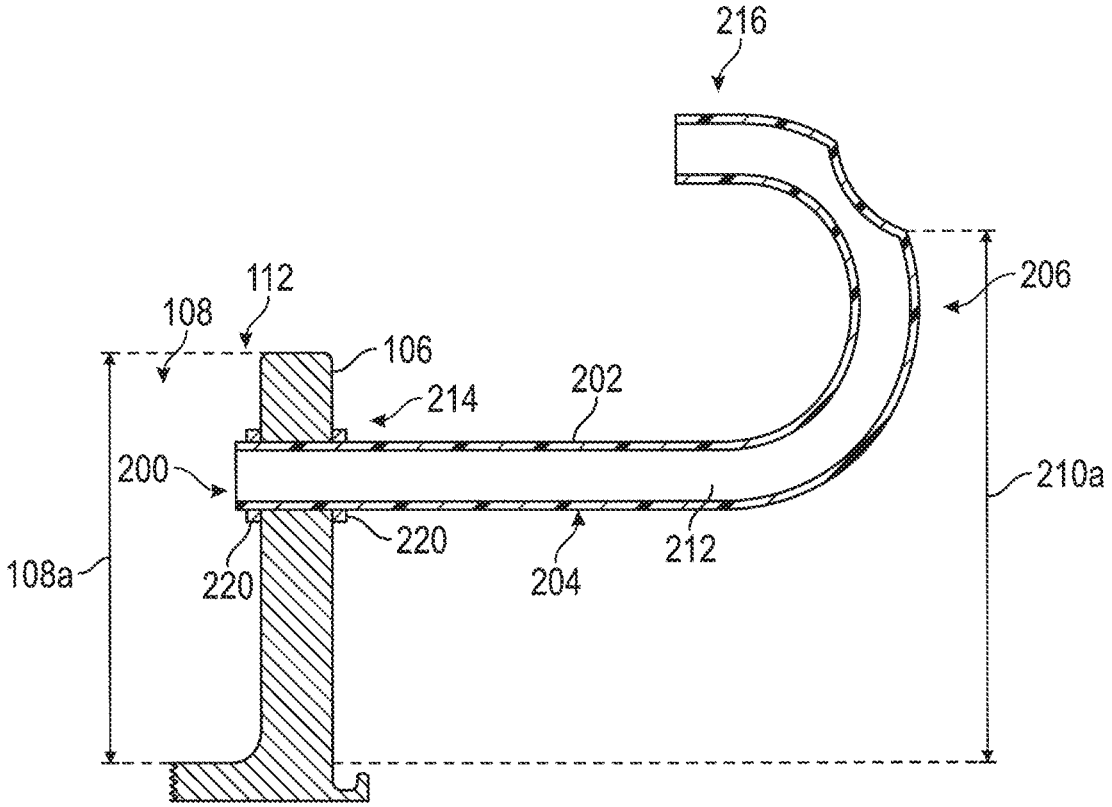
FIG. 14 is a sectional view of a tree stand assembly according to an embodiment of the present invention, including a sectional view of a portion of the housing and the side tube of the assembly.

In another embodiment, a similar arrangement of slots 126 and straps 124 are achieved, but with only one slot 126 associated with each strap 124. This is shown in FIGS. 11-13, which provides a molded stand assembly 100 that is easily stacked in a retail environment by providing a cavity on the underside of the assembly (FIG. 13) that receives the molded interior components of the assembly that form the inner chamber 108 as well as the slots 126 (FIG. 11). In this embodiment, each slot 126 is positioned opposite the tightening assembly 164 within the inner area 108, and each slot and tightening assembly together hold a respective strap 124 in position within the area 108.

The adjustable straps 124 include a first end 130, a second end 132, a length 134, and a width 136. The material of the adjustable straps 124 preferably are formed of a malleable metal that is capable of repeated bending without breaking. Other materials, such as plastic polymers, may also be used, which provide a rigid strap for tightening and may bend without breaking. The adjustable straps 124 preferably include a plurality of slits 138 in at least a region of the strap associated with the tightening assembly, formed as a void of the strap along an extent of the width 136 of the strap 124. The slits 138 are preferably equally spaced apart from each other along a portion of the length 134 of the straps adjacent to the first end 130 as shown in FIG. 2. The slits 138 of the straps provide at least one surface that is suitable for mating with an engagement surface of the tightening assembly as described and shown herein.

Each tightening assembly 164 is preferably a structure that provides an engagement surface which engages with and may be forced against at least one mating surface of the respective strap 124. Specifically, in a preferred form of the invention, each strap 124 has a first end segment engaged with a respective tightening assembly 164 that is secured to the wall, and a second end portion engaged with a slot 126 of the wall, located generally opposite the tightening assembly. Each tightening assembly 164 has a rotatable threaded body 150 (also referred to herein as "torque mechanism") and an actuator 168 for rotating the threaded body, wherein the plurality of slits 138 are aligned to engage with a surface of the rotatable threaded body 150. When the threaded body 150 is rotated, engagement of the respective surfaces exerts a force to move the strap 124 through the tightening assembly 164 to reduce the size of loop 166 of the strap 124. In the embodiment shown in the figures, the tightening assembly 164 has a housing 154 at least partially surrounding the rotatable threaded body 150, and a passageway 140 dimensioned to receive the strap into the housing and permit the strap to move through the housing as it is forced to move.

Figure 4:
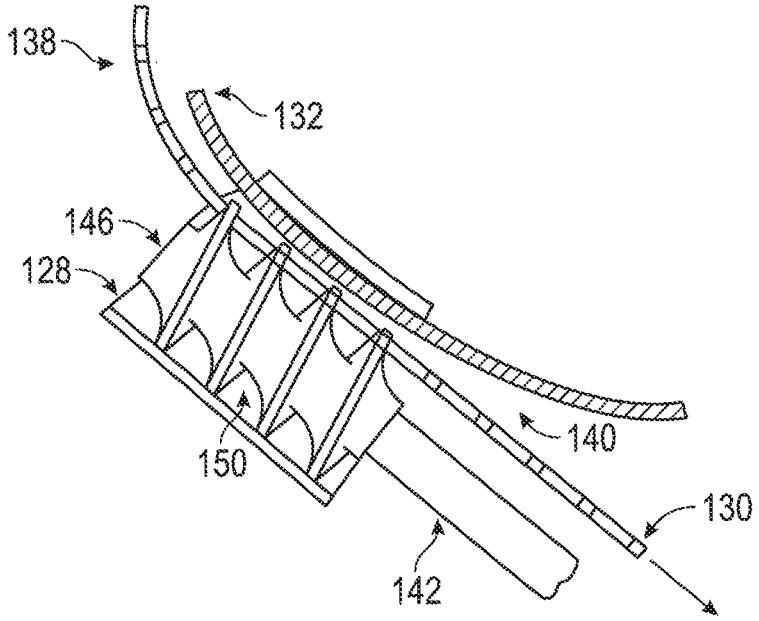
FIG. 4 shows a partially exploded view of a portion of the assembly in FIG. 3.

In the embodiment shown, this arrangement may be provided by a common metal strap and helical screw assembly, arranged in accordance with the invention. In this arrangement, the slits 138 in the strap 124 are engaged with the helical threaded body 150 that is rotated by an actuator, which may be a hand-turning mechanism or may include a socket for a mating key, or may be my a motor driven (not shown) actuator assembly. As shown, the actuator preferably has a first end 146 that is integrally connected to the threaded body 150, and a second end 148 that is exposed from the housing to provide access of the actuator by a user at an extent away from the wall. In the embodiment shown in FIGS. 1-3, the assembly 100 includes at least one rod 142 as an actuator, which is integral with the helical threaded body. Each rod 142, one associated with a respective tightening assembly 164 of a corresponding strap 124, allows access for the user to adjust the straps 124. The material of the rods 142 is preferably metal or other durable material. In the embodiment shown in FIGS. 2-3, the side wall 106 may include a hole 144 for receiving the respective actuator rod 142. Each such hole 144 coincides with cavities or channels within the side wall 106 to allow the rods 142 to pass into the inner area 108 to drive a tightening assembly. Preferably, when the rod 142 is integral with the helical thread 150 the engagement surface of the thread 150 corresponds with and engages against mating surfaces of the plurality of slits 138 of the adjustable strap 124 as shown in FIG. 4. Thus, rotation of the threaded body by turning the rod urges against the plurality of slits 138 of the adjustable strap 124 to move the strap relative the tightening assembly and adjust the size of the loop of the strap 124.

The rods 142 may each also include a handle 152 positioned on the second end 148 of the rods 142 that extends beyond the sides 106 of the assembly 100. Each such handle 152 provides a gripping area for the user to rotate the rod 142 to adjust the straps. The handle 152 may be integral with the rod 142 or may be attached to the rod 142 by friction fit and/or using a adhesive. For example, the user may simply grip the exposed handle 152 at an area away from the wall and rotate the handle 152 clockwise to rotate the rod 142 which then rotates the treaded body 150 to advance the threading against the plurality of slits 138 of the strap 124 to tighten the loop of the strap 124. Alternative manipulation of the tightening assembly may include a motor that rotates the threaded member.

Figure 5:
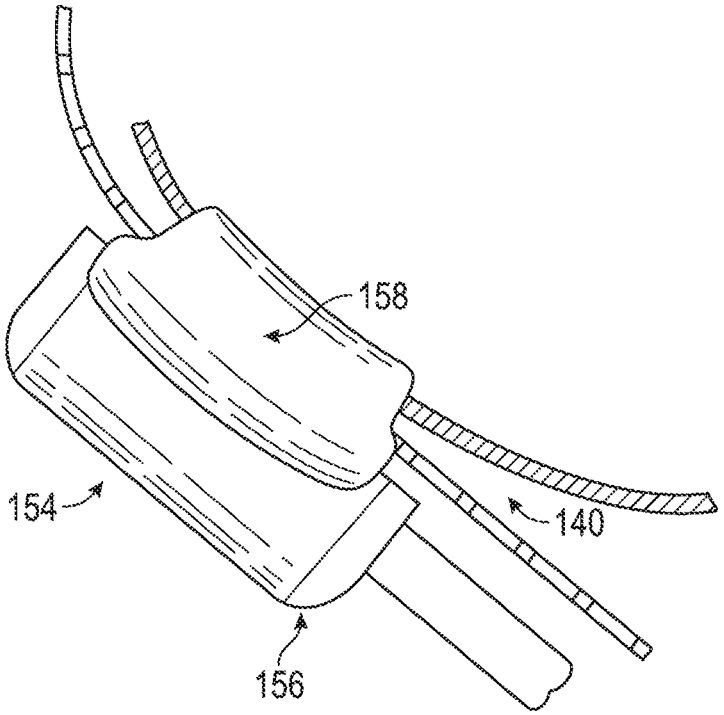
FIG. 5 shows a tightening assembly with an external housing such as shown in FIG. 4.
Figure 6:
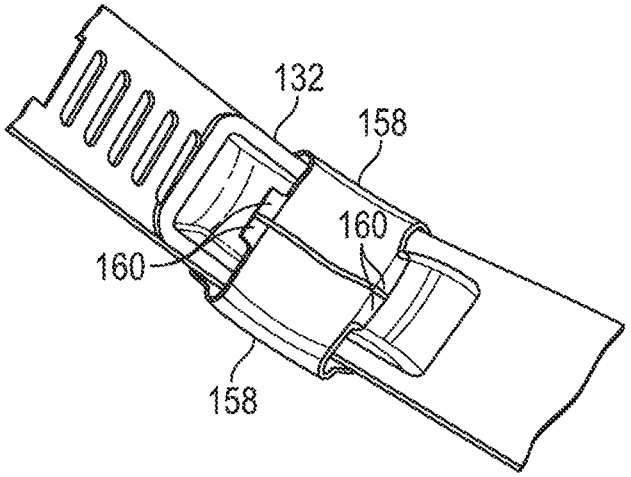
FIG. 6 shows an underside view of the tightening assembly shown in FIG. 5.
Figure 7:
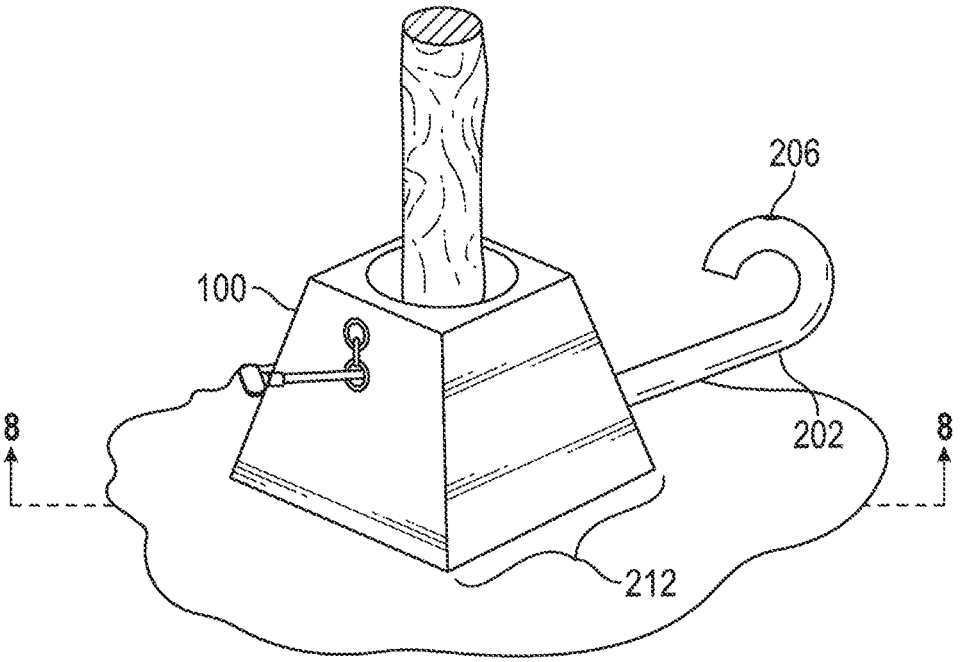
FIG. 7 shows a perspective view of an embodiment of a tree stand assembly according to the present invention.

The tightening assembly also preferably includes a housing 154 which defines a space for maintaining the threading 150 and strap 124 engaged, as shown in FIG. 5. The housing 154 includes a main body 156 and two branches 158 which extend from opposite sides of the main body 156. The branches 158 include a first end, a second end, a length, and a width. The second end of the branches 158 include two end portions 160 that extend beyond the width of the branches 158 as shown in FIG. 6. The branches 158 wrap around a portion of the straps 124 to lock the end of the strap into position relative the housing, providing a secure attachment.

In this embodiment, to adjust the length 134 of one of the straps 124, a user rotates the handle 152 clockwise to thereby rotate the rod 142 and advance the helical threaded body 150 along the plurality of slits 138 of the strap 124 to tighten the strap 124. This is achieved by force applied between the engagement surface of the treaded body and the mating surface of the strap, located at the slits in this embodiment. The housing 154 maintains the engagement position between the threaded body 150 and the plurality of slits 138 of the strap 124, such that the strap 124 moves within the housing 154 through the opening 140, yet the strap remains engaged with the threaded member. Conversely, as the handle 152 and the threaded body are rotated in the opposite direction, the strap 124 moves through the housing in the opposite direction to loosen the strap 124.

In another aspect of the present invention, the stand assembly includes a watering tube 202 with a first section 204 and a second section 206. The first section 204 extends from the opening 200 and for a length beyond the branches of a tree. The first section 204 extends beyond the branches of the tree so a user does not have to crawl underneath the branches to water the tree. The second section 206 extends from the first section 204 and is curved. The second section 206 includes an opening 208 for pouring water into the watering tube 202. Since water seeks its own level, the height 210 of the opening 208 is preferably the same height or less than the height 122 of the hollow chamber or inner area. This arrangement will prevent the assembly 100 from overflowing with water, and the user of the assembly 100 will not have to crawl under the branches of the tree to identify the water height within the assembly 100. The user will be able to see within the opening 208 of the second section 206 whether there is sufficient water in the assembly 100.

In this aspect of the present invention, therefore, the stand assembly includes a base and at least one circumferential wall 106 forming an inner chamber 108 having an upper opening 112 positioned at a height 108*a* above the base 104, with a side opening 200 in the wall 106 and an elongated tube 202 extending radially outward from the side wall 106. The tube 202 has an inner passageway 212 between a proximal end 214 leading from the side opening 200 of the side wall to a first portion 204 and a second portion 206 of the tube 202, and a distal end 216 that positioned a distance outward from the wall. An extent of the portion 206 near the distal end 216 of the tube 202 includes an upward curved portion that leads to a terminal end 218. A region of the tube 202 is curved approaching the distal portion, and has an upper opening 208 that is suitable for receiving a supply of water poured into the tube opening 208, which then passes through the inner passageway 212 and into the inner chamber 108 of the stand assembly 100.

In a preferred form of this aspect of the invention, the upper opening 208 of the tube is located at a height 208 greater than half of the height of the inner chamber but below the top of the inner chamber 108. In other words, the tube opening 208 located at the upwardly curved portion of the tube is positioned at a height 210 that is no greater than the height of the inner chamber 108*a*, or the overall height 122 of the main body of the assembly 100. Therefore, filling the tube 202 with water to provide a supply of water to the inner chamber 108 may be achieved, but the water level in the inner chamber 108 will not exceed the inner chamber height 108*a* without also flowing from the tube opening 202, thus providing a user indication that the inner chamber 108 is full and preventing over fill. Thus, in a preferred embodiment, the upper tube opening 210 is located at a height 210*a* that is generally equal to, or greater than, the height 108*a* of the opening at the top 102 of the inner chamber 108. As shown in the figures, and especially FIGS. 7-8 and 14, the tube 202 has a first portion 204 extending from the wall in a generally horizontal direction, and the tube curves upwardly at the second portion 206. In this manner, the upper opening 208 of the tube 202 may be formed as a part of the side of the tube being absent, and the opening 208 is located along the upper area of the curved portion. This structure provides a tube 202 extending horizontally at a height at approximately at the middle of the inner chamber height 108*a*, and an upper opening 208 that is located a suitable extent from the wall 106 and at a height 208*a* approximately equal to the height of the inner chamber 108.

Further, in a preferred form of this embodiment, the tube 202 may be integral with the wall 106 of the assembly 100 to minimize any leaking of water through the opening 200. Thus, the material forming that part of the watering tube 202 may include a plastic polymer like material as the side wall 106, and a suitable weld or adhesive or other forming material may be used to fuse or seal the connection of the tube and the wall 106. Alternatively, the proximal end of the tube passes through the side opening 200 in the wall 106, and a gasket seal assembly 220 is positioned against the tube 202 adjacent at least one side of the side wall 106 at the opening 200. This arrangement may include a threading on the outer surface of the tube 202 near the proximal end 214 of the tube (not shown) and a threaded nut that forces a gasket against the wall 106 and locks the tube 202 in place against another member of the gasket assembly 220 on the outside of the sidewall 106.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A tree stand assembly, comprising:

a housing having a base and an upper body, said upper body having a top opening configured for receiving an extent of a bottom or trunk of a tree, said upper body of the housing further having an upstanding sidewall extending from at least a portion of the base wherein said sidewall has an extent with a circumferential arrangement to define an inner chamber having a chamber height between the bottom of the sidewall and said top opening;

a securement assembly with at least one adjustable strap residing along a generally horizontal plane within said inner chamber, and a tightening mechanism;

said strap having a loop segment with a diameter configured to surround a tree base, wherein movement of the strap across said tightening mechanism reduces said diameter of the loop segment such that the strap engages directly with an outer surface of the tree base;

wherein said loop segment of the strap has a first portion engaged with a stationary slot of the sidewall, and said loop segment has a second portion engaged with said tightening mechanism.

2. The assembly of claim 1, wherein the sidewall has a projection with an extent spaced from the sidewall to form said slot within the chamber, wherein said strap passes through said slot to provide a connection of the strap to the projection while permitting movement of the strap along the projection when the loop diameter is reduced.

3. The assembly of claim 1, wherein said at least one strap is engaged with at least two slots arranged about the inner chamber and said loop segment comprises two loops within the inner chamber, with a central region of the first loop residing generally along a first horizontal plane and a central portion of the second loop residing along a second horizontal plane located adjacent the first plane.

4. The assembly of claim 3, wherein said two loops are formed from a single elongated strap.

5. The assembly of claim 3, wherein said two loops are each formed of a separate strap.

6. The assembly of claim 1, wherein the at least one adjustable strap comprises a first end, a second end, a length, a width, and a plurality of slits formed along an extent of the width of the strap adjacent the first end, said slits comprising a plurality of mating surfaces of the strap, and wherein an engagement surface of the tightening mechanism is comprised of a threaded surface aligned adjacent the slits of the strap.

7. The assembly of claim 6, wherein the tightening mechanism comprises a housing with a threaded body positioned adjacent a passageway dimensioned for receiving said first end of the strap.

8. The assembly of claim 7, wherein the tightening mechanism further comprises an actuator comprising a rod having a first end, a second end, and a length, said first end of the rod being connected to the threaded body.

9. The assembly of claim 8 wherein, the first end of said rod has a helical threading that forms the threaded body.

10. The assembly of claim 7, wherein the housing of the tightening mechanism comprises a main body and two branches, the main body extending circumferentially around the extent of the threaded body and said two branches extending outwardly from the main body on opposite sides of the main body to form said passageway.

11. The assembly of claim 8, wherein said second end of the rod comprises an engageable portion located radially outward of said sidewall of the stand assembly.

12. The assembly of claim 1, wherein the sidewall comprises an opening and an elongated tube extends radially outward from the sidewall, said tube having an inner passageway between a first end at said opening in the sidewall and a second end positioned an extent outward from the sidewall for receiving fluid into the passageway.

13. The assembly of claim 12, wherein said second end of the tube comprises an upward curved portion of the passageway which terminates at an upper opening, said upper opening being located at adjacent an upper portion of said height of the inner chamber.

14. The assembly of claim 1 wherein said sidewall is comprised of four sides that cooperatively form a pyramid-shaped portion of the housing.

15. A stand assembly comprising:

a base, a wall, and a securement assembly;

said securement assembly having two adjustable straps, each said strap arranged as a loop residing generally along a respective horizontal plane;

each said strap having a first end segment engaged with a tightening mechanism secured to the wall and a second end portion engaged with a slot of the wall located generally opposite the tightening mechanism;

said tightening mechanism of each said strap comprising a rotatable threaded body and an actuator;

wherein an extent of the first end segment of each said strap has a plurality of slits aligned to engage with the rotatable threaded body of the respective tightening mechanism, and wherein rotation of the threaded body forces the first segment of the strap through the tightening mechanism to reduce the size of the loop of said strap, such that the strap engages directly with an outer surface of an object secured to the base by the securement assembly.

16. The assembly of claim 15, wherein the tightening mechanism comprises a housing at least partially surrounding said rotatable threaded body, and having a passageway dimensioned to receive said first end of the strap to position said strap in engagement with the rotatable threaded body.

17. The assembly of claim 15 wherein, said actuator has a first end integrally connected to the threaded body and a second end exposed from said housing to provide access of the actuator by a user at an extent away from the wall.

18. The assembly of claim 17 wherein, the actuator includes an elongated rod that extends radially outward through a side opening of the wall.

19. The assembly of claim 15 wherein, the actuator is configured to mechanically drive rotation of the threaded body.

20. A stand assembly, comprising;

a body having a circumferential wall having an inner area, and a securement assembly;

said securement assembly comprising at least one elongated strap residing along a generally horizontal plane and a tightening mechanism, said strap having an extent arranged as a loop within said inner area, and said strap being secured by engagement with a slot located at a first position along said wall, and said tightening mechanism is positioned at a second location along said wall, said first position is generally opposite said second location within said inner area of the circumferential wall;

said tightening mechanism having a housing and an actuator, said housing having a torque mechanism and an inner passageway for receiving an extent of said strap, said actuator being connected to the torque mechanism such that manipulation of the actuator forces an engagement surface of the torque mechanism against a mating surface of the strap to force movement of the strap through the inner passageway and thereby reduce the length of the strap loop, such that the strap engages directly with an outer surface of an object secured to the body by the securement assembly within the inner area.

21. A decorative tree stand assembly having a securement mechanism for engaging a lower portion of a tree in upright position, and having a base and at least one circumferential wall forming an inner chamber having an upper opening positioned at a height above the base, said wall having a side opening in fluid communication with said inner chamber and with an elongated tube extending radially outward from the wall, said tube having an inner passageway between a proximal end at said side opening of the wall and a distal end positioned an extent outward from the wall, wherein an extent of the distal end of the tube includes an upward curved portion leading to a terminal end, said distal end further having an upper tube opening, wherein said upper tube opening is located at a height that is not greater than said height of the inner chamber.

22. The assembly of claim 21 wherein said upper tube opening is located at a height greater than half of said height of the inner chamber.

23. The assembly of claim 21 wherein said upper tube opening is located at a height generally equal to said height of the inner chamber.

24. The assembly of claim 21, wherein a first portion of the tube extends horizontally from the wall and wherein said upper opening of the tube is located in a side of the tube along said curved portion at a distance away from the terminal end.

25. The assembly of claim 21, wherein the proximal end of said tube passes through the side opening in the wall and a gasket is positioned around the tube adjacent said side opening of the wall.

* * * * *